US008800113B1

(12) United States Patent
Charvet

(10) Patent No.: US 8,800,113 B1
(45) Date of Patent: Aug. 12, 2014

(54) RIGID MODULAR CONNECTOR

(71) Applicant: Blackstone Medical, Inc., Lewisville, TX (US)

(72) Inventor: Jose Luis Charvet, Fairfield, NJ (US)

(73) Assignee: Blackstone Medical, Inc., Lewisville, TX (US)

( * ) Notice: Subject to any disclaimer, the term of this patent is extended or adjusted under 35 U.S.C. 154(b) by 0 days.

(21) Appl. No.: 13/839,811

(22) Filed: Mar. 15, 2013

(51) Int. Cl.
*A45C 13/26* (2006.01)
*B25G 1/10* (2006.01)

(52) U.S. Cl.
USPC ..... 16/436; 16/422

(58) Field of Classification Search
USPC ..... 16/429, 427, 422, 405, 436, 426; 81/177.1, 177.2, 489; 15/143.1, 144.1, 15/144.4, 145, 159.1, 235.8, 236.3; 294/57, 19.1, 19.2, 19.3; 600/106, 131, 600/101, 129, 567, 585; 606/1, 86 R, 170; 403/109.1, 109.2, 109.4, 292, 294, 403/297, 300, 313, 304, 329, 348, 373, 403/374.1, 379.6
See application file for complete search history.

(56) References Cited

U.S. PATENT DOCUMENTS 5,112,156 A * 5/1992 Boyer ..... 403/287
5,168,693 A * 12/1992 Ingvardsen ..... 56/400.04
5,288,161 A * 2/1994 Graves et al. ..... 403/324
5,502,864 A * 4/1996 Sorenson ..... 15/230.11
5,758,023 A * 5/1998 Bordeaux ..... 704/232
6,023,812 A * 2/2000 Morad ..... 15/257.7
6,273,882 B1 * 8/2001 Whittier et al. ..... 606/1
6,398,660 B1 * 6/2002 Probst et al. ..... 473/44
6,461,075 B2 * 10/2002 Bickel ..... 403/409.1
6,605,077 B2 * 8/2003 Whittier et al. ..... 606/1
6,669,702 B2 12/2003 Lechot
6,783,462 B1 * 8/2004 Costain ..... 473/44
6,874,201 B2 * 4/2005 Ta et al. ..... 16/429
6,952,862 B2 * 10/2005 Axelsson ..... 16/422
7,241,226 B2 * 7/2007 Costain et al. ..... 473/44
7,431,342 B2 * 10/2008 Sauer ..... 285/92
7,721,391 B2 * 5/2010 Bukovitz et al. ..... 16/429
2005/0050663 A1 * 3/2005 Goulet ..... 15/144.4
2005/0097691 A1 * 5/2005 Tsuchiya et al. ..... 15/144.4
2005/0249550 A1 * 11/2005 Liang ..... 403/348
2009/0235512 A1 * 9/2009 Bensussan et al. ..... 29/525
2011/0013980 A1 * 1/2011 Bensussan et al. ..... 403/373
2011/0257635 A1 * 10/2011 Whitman et al. ..... 606/1

* cited by examiner

*Primary Examiner* — Chuck Mah
(74) *Attorney, Agent, or Firm* — Baker & McKenzie LLP

(57) ABSTRACT

A rigid modular connector operable to attach to any type of standard male surgical feature that is suitable for large axial loads in both rotational and translational directions while providing accurate tactile feedback. The rigid modular connector includes a handle, a connector rigidly affixed to a proximal end of the handle, and a collar that may slide longitudinally about the connector. The collar may further include one or more leaf springs that are operable to pivot slightly away from or closer to the collar. When the collar slides towards the handle on the connector, the one or more leaf springs may pivot inwardly, locking the collar with the handle in an open position. When the collar slides or the collar slides towards a proximal end of the connector, the one or more leaf springs may pivot outwardly, locking the collar with the connector in a closed position.

23 Claims, 4 Drawing Sheets

RIGID MODULAR CONNECTOR

FIELD OF THE INVENTION

The present disclosure relates to a modular connector operable to attach to any type of standard male surgical feature, and related methods of using a modular connector operable to attach and rotate and/or translate any type of standard male surgical feature. In an embodiment, the modular connector may allow for a rigid connection between a shaft and the connector while maintaining modularity.

BACKGROUND OF THE INVENTION

Surgeons frequently use instruments comprising a handle connected to an elongated shaft during a variety of surgical procedures. These instruments may be used, for example, to rotate a screw or to translate an instrument such as a rasp to prepare a surgical surface.

Often, a surgeon may need to insert one or more screws into the human body in order to stabilize or heal certain parts of the human body, especially the spinal region. These screws may include low-profile screws, pedicle screws, cervical screws, polyaxial screws, monoaxial screws, locking screws, self-drilling screws, self-locking screws, self-tapping screws, cannulated screws, hex-head screws, or screws with custom heads and/or threads. Each of these screws requires a driving tool to drive the screw into human bone. While each screw may require a unique driving tool, surgeons may prefer a modular handle that may be combined with multiple connectors and may be configured to drive a plurality of different driven elements.

Surgeons may also be required to prepare a surgical location for surgery. For example, in a spinal procedure, disc space may need to prepared so that an injured vertebrate disc may be repaired or removed or an artificial vertebrate disc may be inserted. In order to prepare this disc space, an handle attached to an instrument such as a curette or a rasp may be used in a translational and/or rotational motion to prepare the disc space for further surgical procedures.

However, conventional modular handles comprise either a connection and/or a fiddle that is not suitable for large axial loads in both rotational and translational direction, making them unsuitable for some applications where forceful action and tactile feedback are needed. These modular handles often give incorrect tactile feedback, which is critical to screw insertion and surgical surface preparation.

Therefore, a surgical tool operable to maintain a rigid connection between a shaft and a handle while maintaining modularity is desirable.

BRIEF SUMMARY

Disclosed herein is a rigid modular connector comprising a handle, a collar, and a connector. The handle may comprise a distal end, a proximal end, and an internal handle recess extending longitudinally within the handle from the proximal end and ending at a threaded recess. The collar may comprise a distal end, a proximal end, and an internal collar aperture extending from the distal end to the proximal end and is operable to longitudinally slide within the internal handle recess of the handle. The collar may further comprise one or more leaf springs, wherein the one or more leaf springs each may comprise one collar external capture extending from and proximal to an outer surface of the proximal end of the collar and separated by one slot on each side of the collar external capture. Each slot may extend from the proximal end of the collar substantially halfway to the distal end of the collar and extends from the outer surface of the collar to an inner surface of the collar. The connector may comprise a distal end and a proximal end and is operable to be received within the internal collar aperture of the collar and rigidly affixed within a distal end of the internal handle recess of the handle. The proximal end of the connector further may further comprise a female drive feature operable to receive a male drive feature. Advantageously, the one or more leaf springs may be operable to pivot slightly away from or closer to a center longitudinal axis defined through the internal collar aperture of the collar, thereby locking the collar with either the handle or the collar.

BRIEF DESCRIPTION OF THE DRAWINGS

Embodiments are illustrated by way of example in the accompanying figures, in which like reference numbers indicate similar parts, and in which.

DETAILED DESCRIPTION

Figure 1:
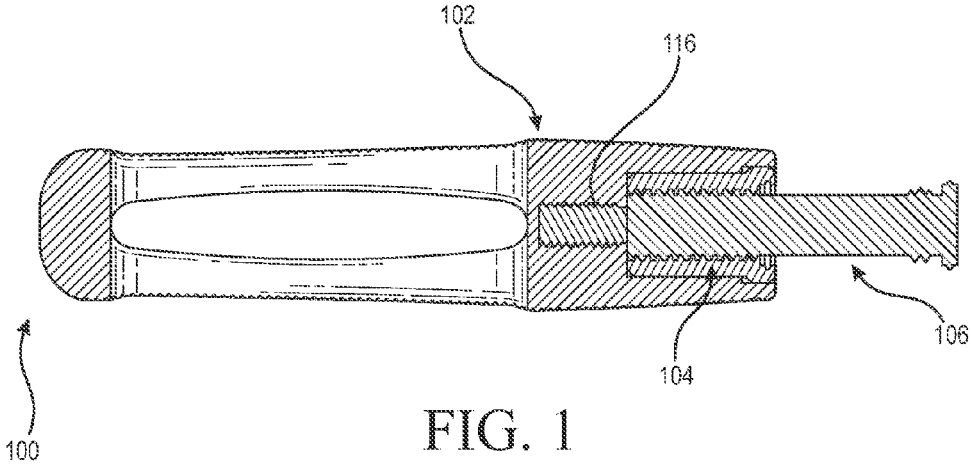
FIG. 1 illustrates a cross-sectional view of a rigid modular connector, in accordance with one embodiment of the present disclosure.
Figure 2:
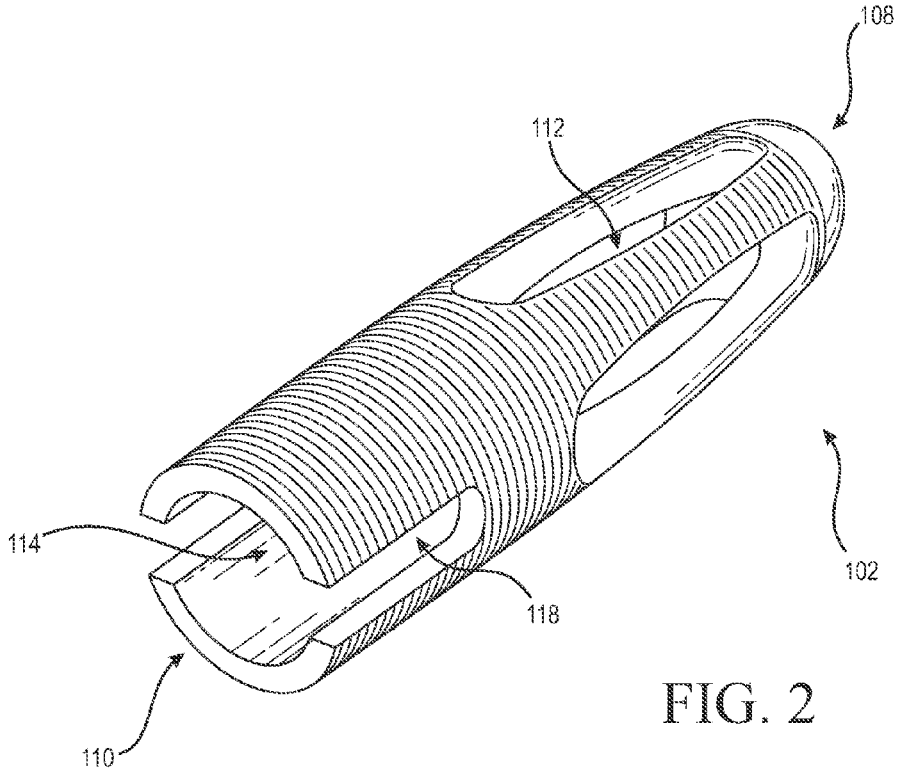
FIG. 2 illustrates a perspective view of a handle of the rigid modular connector of FIG. 1, in accordance with one embodiment of the present disclosure.
Figure 3:
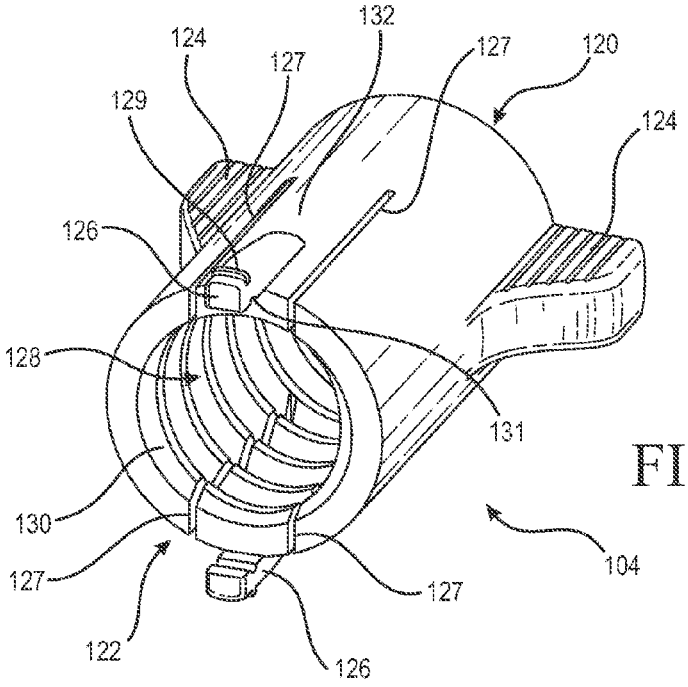
FIG. 3 illustrates a perspective view of a collar of the rigid modular connector of FIG. 1, in accordance with one embodiment of the present disclosure.
Figure 4:
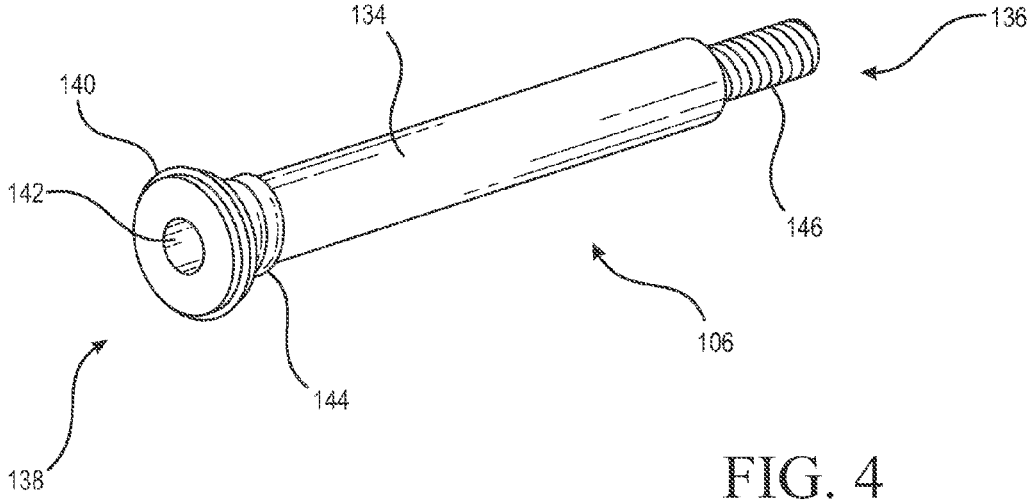
FIG. 4 illustrates a perspective view of a connector of the rigid modular connector of FIG. 1, in accordance with one embodiment of the present disclosure.
Figure 5:
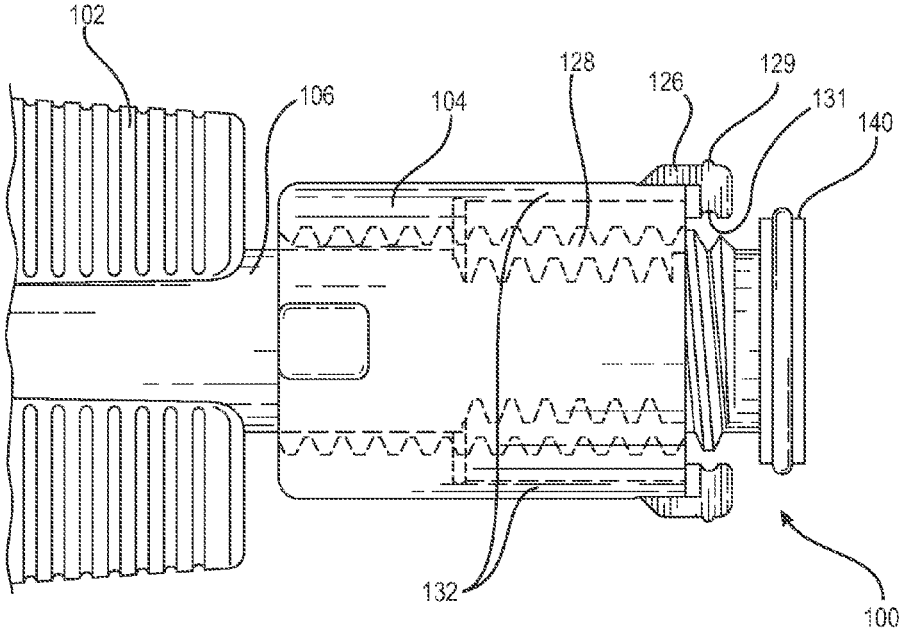
FIG. 5 illustrates a cross-sectional view of the internal workings of a collar and a connector of the rigid modular connector of FIG. 1, in accordance with one embodiment of the present disclosure.
Figure 6:
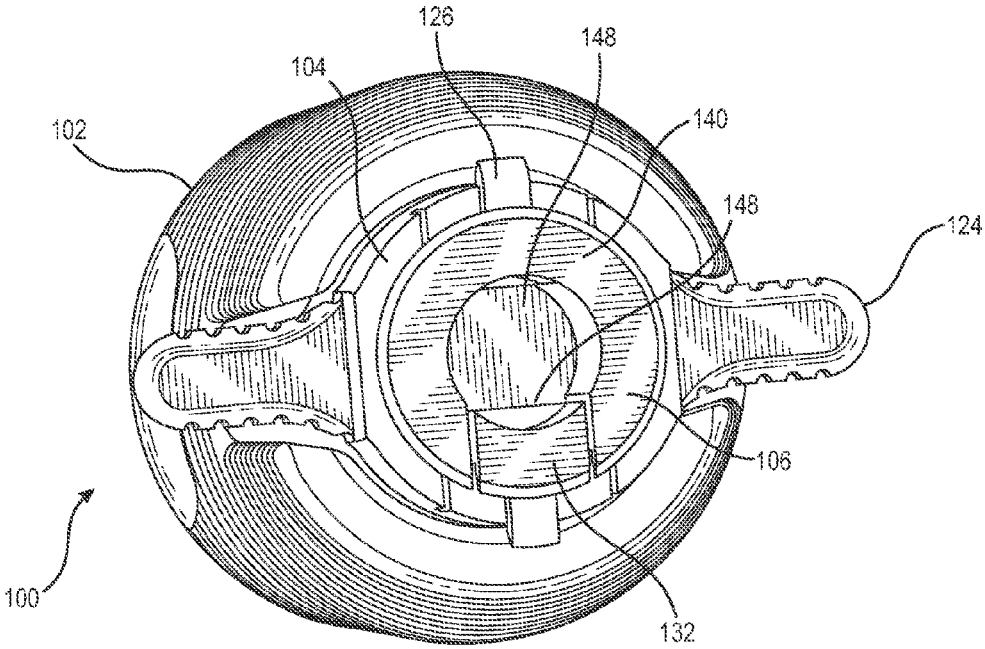
FIG. 6 illustrates a profile view of the proximal end of the rigid modular connector of FIG. 1, in accordance with one embodiment of the present disclosure

FIG. 1 illustrates a cross-sectional view of a rigid modular connector 100, in accordance with one embodiment of the present disclosure. The rigid modular connector 100 comprises a handle 102, a collar 104, and a connector 106. FIG. 2 illustrates a perspective view of the handle 102 of the rigid modular connector 100 of FIG. 1, in accordance with one embodiment of the present disclosure. FIG. 3 illustrates a perspective view of the collar 104 of the rigid modular connector 100 of FIG. 1, in accordance with one embodiment of the present disclosure. FIG. 4 illustrates a perspective view of the connector 106 of the rigid modular connector 100 of FIG. 1, in accordance with one embodiment of the present disclosure. FIG. 5 illustrates a cross-sectional view of the internal workings of the collar 104 and the connector 106 of the rigid modular connector 100 of FIG. 1, in accordance with one embodiment of the present disclosure. FIG. 6 illustrates a profile view of the proximal end of the rigid modular connector 100 of FIG. 1, in accordance with one embodiment of the present disclosure.

As shown in FIGS. 1 and 2, the handle 102 may comprise a distal end 108 and a proximal end 110. The distal end 108 of the handle 102 may be shaped to allow a physician to rotate or translate the rigid modular connector 100 in order to drive or remove a fastener (not shown) or prepare a surgical surface, respectively, coupled with the rigid modular connector 100. In an embodiment, the distal end 108 may be longitudinally shaped with a substantially cylindrical profile and may comprise an internal recess 112 extending to one or more openings in an outer surface of the distal end 108. In an embodiment, the internal recess 112 may extend to four longitudinal openings in the outer surface of the distal end 108 spaced approximately 90° from each other about the outer surface. The internal recess 112 may be operable to reduce the overall weight of the rigid modular connector 100 and to provide gripping locations at the one or more openings. The internal recess 112 may be shaped for aesthetic purposes. The handle 102 may also be shaped in any size and/or shape, for example, an elongated, t-shaped, ball-shaped, small, medium, large, short, long, or flat handle.

The proximal end 110 of the handle 102 may comprise an internal handle recess 114 operable to receive the collar 104 and the connector 106. The size and shape of the internal handle recess 114 may be approximately the same size and shape of the collar 104, as shown in FIG. 3. The internal handle recess 114 may comprise at least two inner diameters—a first, proximal diameter and a second, distal diameter, wherein the first diameter is greater than the second diameter.

The internal handle recess 114 may further comprise a threaded recess 116 located at a distal end of the internal handle recess 114 and operable to receive and fixedly connect with the connector 106, wherein a diameter of the threaded recess 116 is smaller than both the first, proximal diameter and the second, distal diameter of the internal handle recess 114. The threaded recess 116 may comprise female threads operable to mate with male threads of the connector 106, as shown in FIG. 4.

The proximal end 110 of the handle 102 may further comprise one or more opposing slots 118 extending from an outer surface of the handle 102 through to the internal handle recess 114 substantially the entire longitudinal length of the internal handle recess 114, starting at the proximal end 110. The opposing slots 118 may be operable to receive one or more finger scallop tabs on the collar 104 (not shown). In an embodiment, two opposing slots 118 may be spaced approximately 180° apart from each other about the proximal end 110 of the handle 102, although in other embodiments any number of slots 118 may be used that correspond with the number of finger scallop tabs on the collar 104.

As shown in FIGS. 1 and 3, the collar 104 may comprise a substantially cylindrical profile shaped to be received within the internal handle recess 114 at the proximal end of the handle 102. The collar 104 may comprise a distal end 120 and a proximal end 122. The distal end 120 of the collar 104 may comprise one or more finger scallop tabs 124 extending from an outer surface of the distal end 120. The one or more finger scallop tabs 124 may be operable to be received within the one or more slots 118 in the handle 102. In an embodiment, the collar 104 may comprise two finger scallop tabs 124 spaced approximately 180° apart from each other about the distal end 120 of the collar 104, although in other embodiments any number of finger scallop tabs 124 may be used that correspond with the number of slots 118 in the handle 102.

The collar 104 may further comprise one or more leaf springs 132, each comprising an external capture 126 and defined by two slots 127. The slots 127 may extend from the proximal end of the collar 104 from the outer surface of the collar 104 to an inner surface of the collar 104 and extending distally substantially halfway towards the distal end of the collar 104. The slots 127 may be located on each side and proximate to the one or more external captures 126 and may define each leaf spring 132. Each leaf spring 132 may be operable to pivot slightly away from or closer to a center longitudinal axis defined through the internal collar aperture 114 of the collar 104. The one or more leaf springs 132 are each operable to engage both with the handle 102 in the first, open position and engage with the connector 106 in the second, closed position. The collar 104 may be locked in both the first and second positions. In the first, open position, the leaf springs 132 may be operable to collapse inwardly, and in the second, closed position, the leaf springs 132 may be operable to expand outwardly.

The one or more collar external captures 126 may extend outwardly from the outer surface of the proximal end 122 of the collar 104 and may be operable to be received within the first, proximal diameter of the internal handle recess 114 of the handle 102, while the remainder of the collar 104 may be operable to be received within the second, distal diameter of the internal handle recess 114 of the handle 102. The one or more collar external captures 126 may each comprise a female receiving recess 131 in an inner surface of the collar external captures 126 and operable to mate with a male circumferential connector external capture lip (not shown) of the connector 106. The one or more collar external captures 126 may each further comprise a male dome 129 extending outwardly from an outer surface of the collar external captures 126 and opposite to the female receiving recess 131. The male domes 129 may be operable to lock with the first, proximal diameter of the internal handle recess 114 of the handle 102. In an embodiment, the collar 104 may comprise two collar external captures 126 spaced approximately 180° apart from each other about the proximal end 122 of the collar 104, although in other embodiments any number of collar external captures 126 may be used.

The collar 104 may further comprise a collar aperture 128 extending from the distal end 120 to the proximal end 122 and operable to receive the connector 106 therethrough. The collar aperture 128 may be substantially cylindrical in shape and may comprise a collar aperture diameter slightly larger than a connector 106 diameter so that the collar 104 may slide from a first, open position to a second, closed position about the connector 106, and as discussed in more detail in relation to FIGS. 7 and 8. The collar aperture 128 may comprise internal female threads 130 operable to mate with male threads (not shown) of the connector 106. The connector 106 may be operable to be received within both the collar aperture 128 and the leaf spring 132.

As shown in FIGS. 1 and 4, the connector 106 may comprise a cannulated cylinder 134 with a distal end 136 and a proximal end 138. At the proximal end 138, the connector 106 may comprise a female drive feature 140 operable to receive a male drive feature (not shown) at a internal connector recess 142. The internal connector recess 142 may be sized and shaped to receive any desirable male drive feature. An outer circumference of the female drive feature 140 may comprise a male circumferential connector external capture lip operable to be received within the female receiving recess of the one or more collar external captures 126 of the collar 104 in the second, closed position.

The connector 106 may comprise male threads 144 proximate to and distal of the female drive feature 140, wherein the male threads 144 are operable to mate with the internal female threads 130 of the collar 104. The male threads 144 may be single, double, or triple threads (leads), requiring the collar 104 to rotate various number of degrees about the connector 106 to lock or unlock the collar 104 from the connector 106. The connector 106 may also comprise a twist-to-lock mechanism in lieu of male threads, wherein, for example, a ¼, ⅓, or ½ twist locks the collar 104 relative to the connector 106.

The connector 106 may further comprise a threaded extension 146 extending from the distal end 136. The male threads of the threaded extension 146 are operable to mate with the female threads within the threaded recess 116 of the handle 102 and fixedly connect the connector 106 to the handle 102.

As shown in FIG. 6, the connector 106 may further comprise one or more captures 148 located within the female drive feature 140. Each capture 148 may comprise a domed surface and a matching recess. The geometry of the domed surface may match a recess of the female drive feature 140, thereby allowing a male drive feature (not shown) to be received therewithin. The geometry of the domed surface may further be operable to allow the leaf spring 132 to pivot outwardly during assembly and disassembly. The capture 148 and the leaf spring 132 may be shaped to receive any standard male drive feature, i.e., round, square, hex-shaped, star-shaped, etc.

Figure 7:
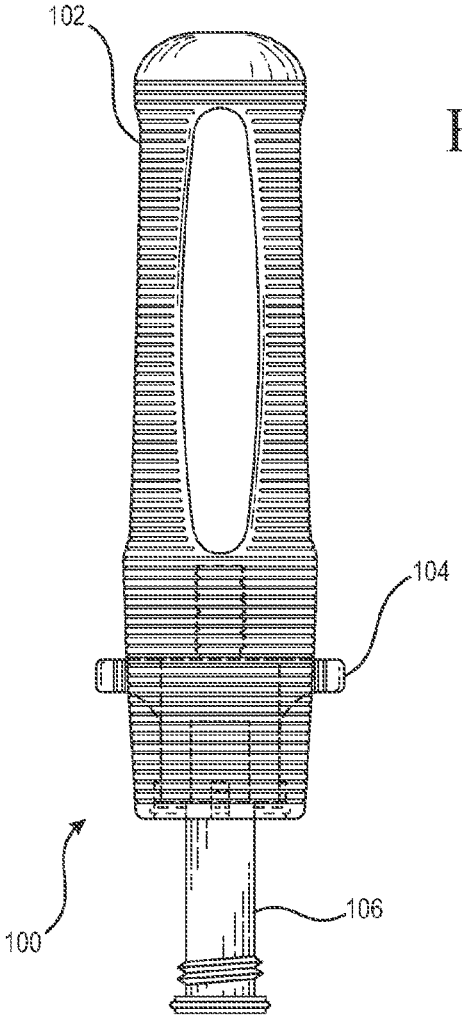
FIG. 7 illustrates a profile view of the rigid modular connector of FIG. 1 in a first, open position, in accordance with one embodiment of the present disclosure.
Figure 8:
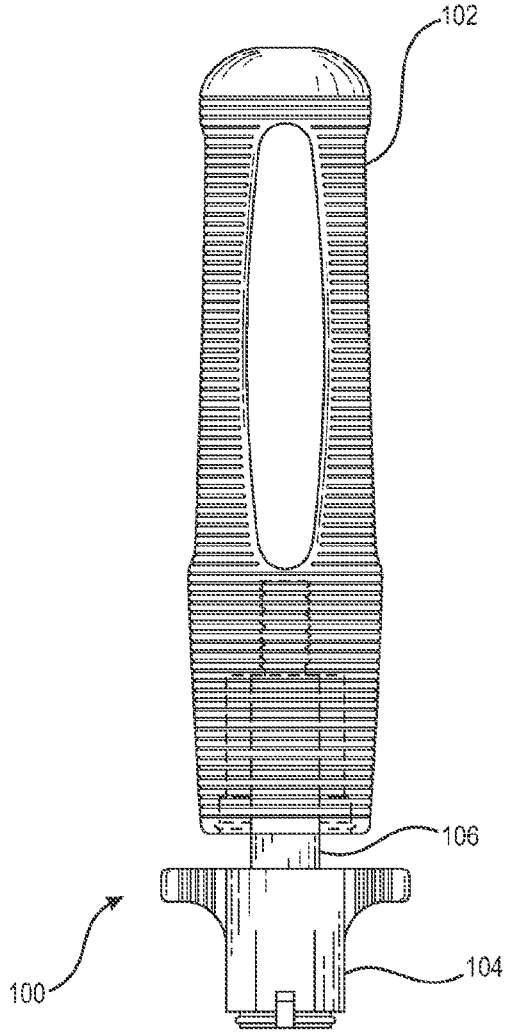
FIG. 8 illustrates a profile view of the rigid modular connector of FIG. 1 in a second, closed position, in accordance with one embodiment of the present disclosure.

FIG. 7 illustrates a profile view of the rigid modular connector 100 of FIG. 1 in the first, open position, while FIG. 8 illustrates a profile view of the rigid modular connector of FIG. 1 in the second, closed position, in accordance with one embodiment of the present disclosure. In operation, the collar 104 is operable to longitudinally move between the first, open position proximate to the handle 102 to the second, closed position proximate to the female drive feature 140 at the proximal end of the connector 106. To move the collar 104 from the second, closed position to the first, open position, a surgeon may use two fingers to distally pull the collar 104 at the one or more finger scallop tabs 124 so that the one or more finger scallop tabs 124 distally slide within the one or more slots 118 in the handle 102 and the collar 104 becomes assembled with the handle 102. To move the collar 104 from the first, open position to the second, closed position, a surgeon may use two fingers to proximally push the collar 104 at the one or more finger scallop tabs 124 so that the one or more finger scallop tabs 124 proximally slide within the one or more slots 118 in the handle 102 and the collar 104 becomes assembled with the connector 106. The amount of resistance required to assemble the collar 104 with the handle 102 in the first, open position is consistent with the amount of force used to distally pull the one or more finger scallop tabs 124. The amount of resistance required to assemble the collar 104 with the connector 106 in the second, closed position is greater than the amount of resistance required to assemble the collar 104 with the handle 102 in the first, open position. The amount of resistance is determined by the size and engagement of the dome 129 and the female receiving recess 131 of the external captures 126.

In the first, open position, the collar 104 may be substantially entirely received within the handle 102 and the collar 104 may lock to the handle 102. When the collar 104 is locked to the handle 102, the leaf spring 132 may be collapsed inwardly relative to the center longitudinal axis defined through the cylindrical profile of the collar 104. When the collar 104 is unlocked, the collar 104 may be free to slide longitudinally along the connector 106. When the collar 104 is slid proximally to the second, closed position, the collar 104 is operable to be rotated in a clockwise direction, wherein the male threads 144 of the connector 106 are operable to mate with the internal female threads 130 of the collar 104, locking the collar 104 with the connector 106. When the collar 104 is locked to the connector 106, the leaf spring 132 may be advanced proximally and extended outwardly relative to the center longitudinal axis defined through the cylindrical profile of the collar 104. In the locked position, the one or more collar external captures 126 may engage with the outer circumference of the male circumferential connector external capture lip of the connector 106. From the locked position, the collar 104 is operable to be rotated in a counterclockwise direction, unlocking the collar 104 from the connector 106 so that the collar is free once again to slide longitudinally along the connector 106.

In operation, when a male drive feature is received within the capture 148, the capture 148 bottoms out within the within the collar aperture 128 and the collar 104 is rotated clockwise and locked with the connector 106, the male drive feature may be locked relative to the capture 148, thereby allowing the rigid modular connector 100 to rotate the male drive feature clockwise or counterclockwise or translate the male drive feature relative to the surgical site.

The dimensions of the rigid modular handle 100 may depend on the surgical procedure and the surgeon's personal preferences. The connector 106 may be sized to receive any type of standard male drive feature that can be contained within an approximately 0.2" to 0.4" shaft at the capture. For example, the connector 106 may be sized to receive any type of standard male drive feature that can be contained within an approximately 0.315" (8 mm) shaft at the capture 148. In an embodiment, the handle 102 may be approximately 5" long from proximal end to distal end and approximately 1.125" wide it its widest point. In an embodiment, the collar 104 may be approximately 0.875" long from proximal end to distal end and approximately 0.625" wide (1.5" including finger scallop tabs 124). In an embodiment, the connector 106 may be approximately 2.75" long from proximal end to distal end and approximately 0.5" wide at the female drive feature 140 and approximately 0.375" wide at the cannulated cylinder 134.

One or more components of the rigid modular connector 100 disclosed herein may be made from any of the following materials: (a) a metal (e.g., a pure metal such as titanium and/or an alloy such as Ti—Al—Nb, TI-6Al-4V, stainless steel); (b) a plastic; (c) a fiber; (d) a polymer; or (e) any combination thereof. In an embodiment, the handle 102, the collar 104, and the connector 106 may each be made from stainless steel. In another embodiment, the connector 106 may be made from stainless steel while the handle 102 and the collar 104 may be made from stainless steel, silicone, titanium, or a combination thereof. The components of the rigid modular connector 100 may be sterilized after surgery and may be reused one or more times in order to save on surgical costs and/or to prevent raw material waste.

While various embodiments in accordance with the principles disclosed herein have been described above, it should be understood that they have been presented by way of example only, and are not limiting. Thus, the breadth and scope of the invention(s) should not be limited by any of the above-described exemplary embodiments, but should be defined only in accordance with the claims and their equivalents issuing from this disclosure. Furthermore, the above advantages and features are provided in described embodiments, but shall not limit the application of such issued claims to processes and structures accomplishing any or all of the above advantages.

It will be understood that the principal features of this disclosure can be employed in various embodiments without departing from the scope of the disclosure. Those skilled in the art will recognize, or be able to ascertain using no more than routine experimentation, numerous equivalents to the specific procedures described herein. Such equivalents are considered to be within the scope of this disclosure and are covered by the claims.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, although the headings refer to a "Field of Invention," such claims should not be limited by the language under this heading to describe the so-called technical field. Further, a description of technology in the "Background of the Invention" section is not to be construed as an admission that technology is prior art to any invention(s) in this disclosure. Neither is the "Summary" to be considered a characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings set forth herein.

What is claimed is:

1. A rigid modular connector comprising:

a handle, wherein the handle comprises a distal end, a proximal end, and an internal handle recess extending longitudinally within the handle from the proximal end and ending at a threaded recess;

a collar, wherein the collar comprises a distal end, a proximal end, and an internal collar aperture extending from the distal end to the proximal end;

one or more leaf springs, wherein the one or more leaf springs each comprise one collar external capture extending from and proximal to an outer surface of the proximal end of the collar and separated by one slot on each side of the collar external capture, wherein each slot extends from the proximal end of the collar substantially halfway to the distal end of the collar and extends from the outer surface of the collar to an inner surface of the collar; and a connector, wherein the connector comprises a distal end and a proximal end and is operable to be rigidly affixed to the handle within the threaded recess of the handle, wherein the proximal end of the connector further comprises a female drive feature operable to receive a male drive feature;

wherein the collar is operable to longitudinally slide about the connector from a first, open position proximate to the handle to a second, closed position proximate to the female drive feature of the connector; and wherein the one or more leaf springs are operable to pivot slightly away from or closer to a center longitudinal axis defined through the internal collar aperture of the collar, thereby locking the collar with either the handle or the connector.

2. The rigid modular connector of claim 1, wherein the handle further comprises an internal recess in the distal end, the internal recess defined by one or more openings within an outer surface of the distal end of the handle.

3. The rigid modular connector of claim 1, wherein the proximal end of the handle further comprises one or more opposing slots extending from an outer surface of the handle through to the internal handle recess substantially the entire longitudinal length of the internal handle recess, starting at the proximal end.

4. The rigid modular connector of claim 3, wherein the one or more opposing slots are operable to receive one or more finger scallop tabs extending from an outer surface of the distal end of the collar.

5. The rigid modular connector of claim 1, wherein the one or more collar external captures comprise a female receiving recess operable to mate with a male circumferential connector external capture lip at the proximal end of the connector.

6. The rigid modular connector of claim 1, wherein a proximal end of the internal collar aperture of the collar comprises female threads.

7. The rigid modular connector of claim 6, wherein the connector comprises male threads proximate to and distal of the female drive feature of the connector, wherein the male threads are operable to mate with the internal female threads of the collar.

8. The rigid modular connector of claim 1, wherein the connector is rigidly affixed to the handle with a threaded extension extending from the distal end of the connector, wherein male threads of the threaded extension are operable to mate with female threads within the threaded recess of the handle.

9. The rigid modular connector of claim 1, wherein the connector comprises a cannulated cylinder extending between the distal end and the proximal end.

10. The rigid modular connector of claim 1, wherein the female drive feature comprises an internal connector recess comprising at least one capture operable to receive a male drive feature.

11. The rigid modular connector of claim 10, wherein the capture is operable to lock relative to the male drive feature.

12. The rigid modular connector of claim 11, wherein the geometry of the domed surface and the geometry of the leaf spring may be round, square, hex-shaped, or star-shaped.

13. The rigid modular connector of claim 1, wherein in the first, open position, the leaf spring is operable to engage with the handle and pivot inwardly relative to the center longitudinal axis defined through the internal collar aperture of the collar, thereby locking the collar to the handle.

14. The rigid modular connector of claim 1, wherein in the second, closed position, the leaf spring is operable to engage with the connector and pivot outwardly relative to the center longitudinal axis defined through the internal collar aperture of the collar, thereby locking the collar to the connector.

15. The rigid modular connector of claim 14, wherein when the collar is slid proximally to the second, closed position, the collar is operable to be rotated in a clockwise direction, locking the collar with the connector.

16. The rigid modular connector of claim 15, wherein the collar is operable to be rotated in a counterclockwise direction, unlocking the collar from the connector so that the collar can slide longitudinally along the connector.

17. The rigid modular connector of claim 1, wherein the handle, the collar, and the connector may be made from the group of materials consisting of: a metal, a plastic, a fiber, a polymer, or any combination thereof.

18. The rigid modular connector of claim 17, wherein the handle, the collar, and the connector are each made of stainless steel.

19. A method of preparing a rigid modular connector for use with a male drive feature during a surgical procedure, the method comprising:

providing the rigid modular connector comprising:

a handle, wherein the handle comprises a distal end, a proximal end, and an internal handle recess extending longitudinally within the handle from the proximal end and ending at a threaded recess;

a collar, wherein the collar comprises a distal end, a proximal end, and an internal collar aperture extending from the distal end to the proximal end;

one or more leaf springs, wherein the one or more leaf springs each comprise one collar external capture extending from and proximal to an outer surface of the proximal end of the collar and separated by one slot on each side of the collar external capture, wherein each slot extends from the proximal end of the collar substantially halfway to the distal end of the collar and extends from the outer surface of the collar to an inner surface of the collar; and a connector, wherein the connector comprises a distal end and a proximal end and is operable to be rigidly affixed to the handle within the threaded recess of the handle, wherein the proximal end of the connector further comprises a female drive feature operable to receive a male drive feature;

longitudinally sliding the collar about the connector between a first, open position proximate to the handle and a second, closed position proximate to the female drive feature of the connector;

wherein the one or more leaf springs are operable to pivot slightly away from or closer to a center longitudinal axis defined through the internal collar aperture of the collar.

20. The method of claim 19, wherein in the first, open position, the one or more leaf springs pivot closer to the center longitudinal axis defined through the internal collar aperture of the collar, thereby locking the collar with the handle.

21. The method of claim 19, wherein the second, closed position, the one or more leaf springs pivot away from the center longitudinal axis defined through the internal collar aperture of the collar, thereby locking the collar with the connector.

22. The method of claim 19, wherein the female drive feature of the connector further comprises an internal connector recess comprising at least one capture operable to receive a male drive feature.

23. The method of claim 22, wherein the capture is operable to lock relative to the male drive feature.

* * * * *